United States Patent [19]

Lawson

[11] 3,980,384

[45] Sept. 14, 1976

[54] TERMINAL BLOCK

[75] Inventor: Gustaf Rudolph Lawson, Willingboro, N.J.

[73] Assignee: AMP Incorporated, Harrisburg, Pa.

[22] Filed: Apr. 28, 1975

[21] Appl. No.: 572,562

[52] U.S. Cl. ..... 339/198 GA

[51] Int. Cl.[2] ..... H01R 9/16

[58] Field of Search ..... 339/198 R, 198 G, 198 GA, 339/276 SF; 206/330, 328, 332; 29/203 B, 423

[56] References Cited

UNITED STATES PATENTS

| | | | |
|---|---|---|---|
| 2,683,506 | 7/1954 | Immel et al. | 339/198 GA |
| 3,182,276 | 5/1965 | Ruehlemann | 29/423 |
| 3,245,029 | 4/1966 | Piperato | 339/198 GA |
| 3,399,444 | 9/1968 | Jacoby | 29/423 |
| 3,611,562 | 10/1971 | Herb | 29/423 |

FOREIGN PATENTS OR APPLICATIONS

| | | | |
|---|---|---|---|
| 829,419 | 3/1960 | United Kingdom | 29/203 B |

*Primary Examiner*—Joseph H. McGlynn
*Attorney, Agent, or Firm*—Allan B. Osborne

[57] ABSTRACT

An electrical connector assembly is disclosed and comprises a plurality of individual connector units secured together in strip form by means of a flexible tape which serves to present the individual units in a form whereby the ultimate user may selectively utilize any particular number of units for use in the final assembly.

8 Claims, 6 Drawing Figures

TERMINAL BLOCK

This invention relates to the art of electrical connectors and more particularly to the art of connectors which are provided in multiple units for use as a terminal block or similar article.

It is known to provide an electrical connector wherein a single integral molding is formed having a plurality of connector units formed as a part thereof. These moldings are often made in various multiples of each other and a customer or end user will typically maintain an inventory of various connector blocks of differing lengths whereby connectors are available to suit various applications and requirements.

It is also known to provide electrical connectors in individual units together with a supporting structure which receives the units, one at a time, so as to form a multiple connector assembly. This is the typical modular or building block type of connector assembly.

It is also known to provide a connector assembly whereby a molding is provided which comprises a plurality of individual connector units with the individual units being connected to each other by a reduced section which is intended later to be severed or broken so as to provide a connector assembly of a desired length.

Each of the various arrangements as set forth above has its drawbacks and it is an object of this invention to provide a connector assembly which has all of the versatility of the above types of connector assemblies while avoiding the drawbacks associated therewith.

The integral molded connector assembly has, as its obvious drawback, the requirement that consumers must have an inventory of many different sizes, which is costly and often wasteful. The modular or building block approach is often unsatisfactory because the consumer must store a large number of individual units in a bin or container and must assemble these units, one at a time, each time a connector assembly is made. This, of course, can be a very time consuming and expensive assembly operation. The approach whereby an integral molding has severable or breakable sections has the drawback that the mold design is extremely complex and expensive to manufacture and it may occur that individual units are broken from each other unintentionally due to the weakened nature of the molded product.

It is therefore an object of this invention to provide individual connector units in a form whereby the units may be conveniently stored in reel form and quickly assembled on a support member so as to form a connector assembly of any desired length.

Other objects and attainments of the present invention will become apparent by reference to the following detailed description and claims, taken in conjunction with the accompanying drawings, in which:

Figure 1:
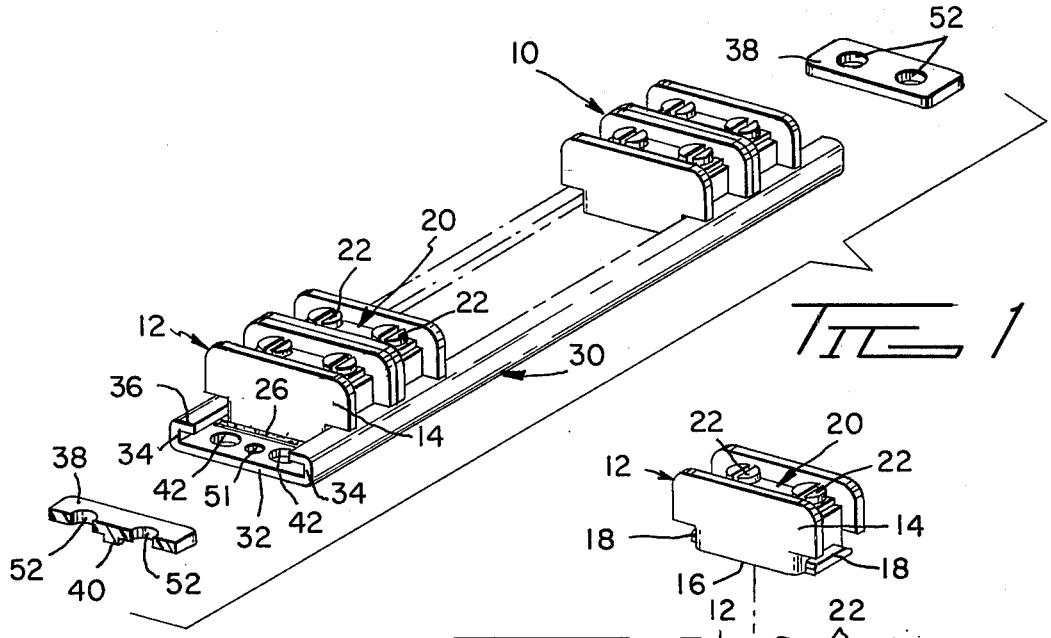
FIG. 1 is a perspective view, partially exploded and partially broken away, showing a connector assembly formed according to the teachings of the present invention.

With reference now to the drawings, and in particular to FIG. 1, a connector assembly is shown and indicated generally at 10. The assembly 10 is formed from a plurality of individual connector units 12, each of the units being shown as identical units although such is not a requirement of this invention. The units 12 are molded from insulating material and comprise a pair of side walls 14 connected by a base 16, with the base 16 terminating in a pair of lateral ears 18 for a purpose to be described. A metallic terminal member 20 is secured to the insulating base by suitable means and includes a pair of terminal posts 22 adapted to receive electrical conductors.

Figure 5:
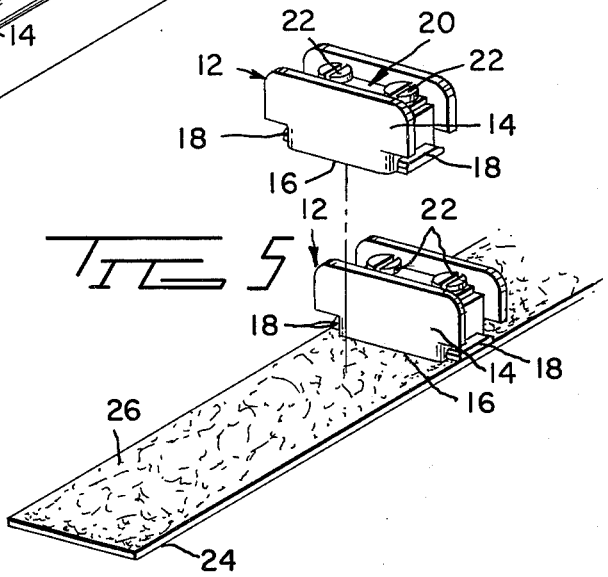
FIG. 5 is an exploded perspective view showing the manner of mounting the connector units on a carrier.
Figure 6:
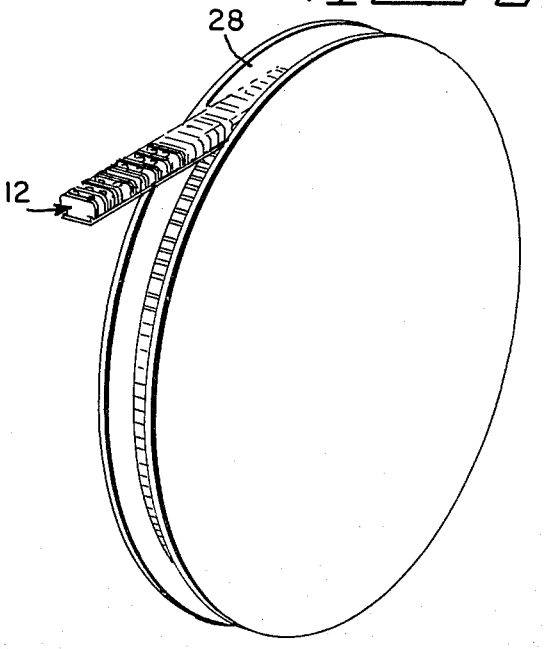
FIG. 6 is a perspective view showing a plurality of connector units mounted on a carrier and supplied in reel form.
Figure 4:
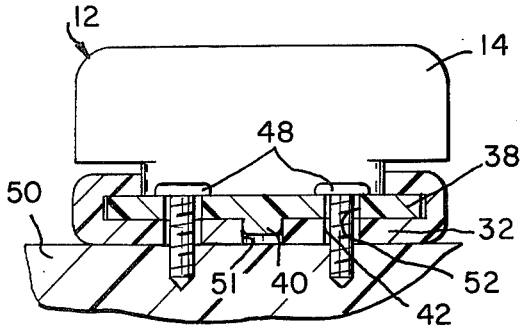
FIG. 4 is a cross-sectional view showing further details of an end portion for the assembly.

Turning now to FIG. 5, there is shown a tape-like member 24 of insulating material having an adhesive surface 26 on one side thereof. The member 24 is a thin flexible member of indefinite length and may consist of any one of several types of tapes which are commercially available. The individual connector units 12 are mounted on member 24 and are held thereon by the adhesive surface 26. Although member 24 is preferably an insulating tape, it may also be a metallic member which could be used, for example, in instances where a common ground plane is desirable. In addition, it is not necessary that the units 12 be adhesively secured to member 24 but rather the units could be ultrasonically bonded to the member, or secured by other known techniques. The units are placed in side-by-side relationship completely along the member 24 so as to form an endless reel of units such as shown at 28 in FIG. 6. The reel 28 of connector units may be conveniently stored and presents connector units in a form which is easily handled.

Figure 3:
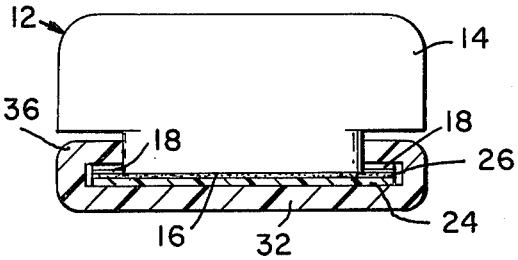
FIG. 3 is a cross-sectional view showing details of the manner in which the connector units are mounted on the support.

Referring again to FIG. 1, a support member 30 is shown and is of generally channel-shaped configuration comprising a base portion 32 from which extends upstanding legs 34 terminating in overhanging portions 36, the overhanging portions lying over the base 32 and generally parallel thereto. The space between the base 32 and the overhanging portions 36 is dimensioned to receive the member 24 and the ears 18 of the individual connector units, such as is shown in FIG. 3. The support member 30 is preferably formed of insulating material and may be of any desired length. Suitably, the member 30 is of greater length than would be necessary for most connector assemblies and the support member is severed to a suitable length to accommodate a particular number of connector units in an assembly. For this purpose, the support 30 may be cut with a suitable tool or may be scored at selected locations to assist the end user in determining the correct location for severing the support.

Figure 2:
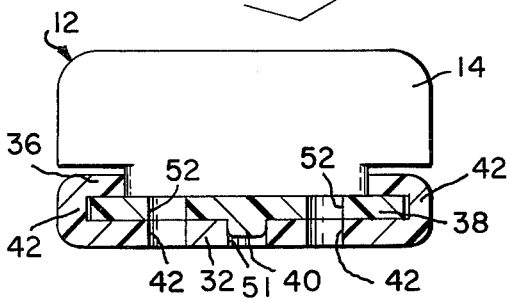
FIG. 2 is a cross-sectional view showing details of an end portion of the assembly of FIG. 1.

The individual connector units are maintained on the support member by end portions 38 which are slidably received within the support member at each of the opposite ends of the connector assembly. With reference to FIG. 2, the end portion 38 has a detent 40 which is received within aperture 51 disposed in the support member 30. Apertures 51 may be conveniently located throughout the length of the support member so as to be present at all locations regardless of the length of connector assembly desired. The end portion further has a pair of apertures 52 which align with apertures 42 in the support member, and a fastener 48 extends through the apertures for securing the support member 30 to a suitable frame 50.

The detents 40 may be formed in the end portions by either a molding or punching process, as desirable.

From the foregoing it can be seen that a connector assembly has been disclosed which achieves the objects set forth and which provides an end user with maximum flexibility while requiring minimum investment in inventory of materials.

Although the invention has been described with reference to particular embodiments, it will be understood to those skilled in the art that the invention is capable of a variety of alternative embodiments within the spirit and scope of the appended claims.

I claim:

1. An electrical connector assembly comprising an elongated channel-shaped member having a base portion, a pair of upstanding legs extending from opposite sides of said base portion, and an overhanging portion extending from each said legs and lying above said base portion and being spaced therefrom, an elongated tape-like member having a securing surface on one side thereof, and a plurality of connector units being of similar configuration, each said unit having a surface secured to the securing surface of said tape-like member and having parallel side surfaces, said units being arranged in side-by-side relationship with side surfaces of adjacent units being in juxtaposition along said tape-like member, said units and said tape-like member being slidably received within said channel-shaped member to thereby form a connector assembly.

2. A connector assembly as set forth in claim 1 wherein said units are adhesively secured to the tape-like member.

3. A connector assembly as set forth in claim 1 wherein each of said units has a pair of lateral ears received within the spaces between the overhanging portions and the base portion of said channel-shaped member.

4. A connector assembly as set forth in claim 3 wherein the lateral ears of the units are secured to the tape-like member.

5. A connector assembly as set forth in claim 1 further comprising end means located at opposite ends of said plurality of connector units, said end means being received within said channel-shaped member.

6. A connector assembly as set forth in claim 5 wherein said end means are removably secured to said channel-shaped member.

7. A connector assembly as set forth in claim 5 wherein said end means have apertures in alignment with apertures in the base of said channel-shaped member.

8. A connector assembly as set forth in claim 7 wherein said end means have detents thereon received within further apertures in said channel-shaped member.

* * * * *